US007002479B1

(12) United States Patent
Huang et al.

(10) Patent No.: US 7,002,479 B1
(45) Date of Patent: Feb. 21, 2006

(54) HARDWARE MONITORING DEVICE

(75) Inventors: Kuo-Hwa Huang, Chung-Ho (TW); Liang-Chyau Sheu, Hsintien (TW)

(73) Assignee: Cooler Master Co., Ltd., Taipei (TW)

( * ) Notice: Subject to any disclaimer, the term of this patent is extended or adjusted under 35 U.S.C. 154(b) by 9 days.

(21) Appl. No.: 10/934,586

(22) Filed: Sep. 3, 2004

(51) Int. Cl.
*G08B 17/00* (2006.01)

(52) U.S. Cl. ..... 340/584; 340/506; 340/511; 340/688; 340/687

(58) Field of Classification Search ..... 340/584, 340/506, 511; 361/688, 687, 683, 704
See application file for complete search history.

(56) References Cited

U.S. PATENT DOCUMENTS 6,643,126 B1 * 11/2003 Su ..... 361/685

FOREIGN PATENT DOCUMENTS

| | | |
|---|---|---|
| TW | 553425 | 9/2003 |
| TW | 573760 | 1/2004 |

* cited by examiner

*Primary Examiner*—Daryl C Pope

(57) ABSTRACT

A hardware monitoring device suitable for use to monitor performance of hardware installed in a computer host system is disclosed. For example, the operating temperature and transmission speed of a hard disk or the temperature of a central processing unit can all be monitored by such device. The monitored information can also be displayed on a panel as a reference for adjustment of a heat dissipation fan. By the connection via a firmware, the adjustment of the heat dissipation fan and the monitored information of the hardware can be directly accessed from the operation system of the computer.

16 Claims, 10 Drawing Sheets

HARDWARE MONITORING DEVICE

BACKGROUND OF THE INVENTION

The present invention relates in general to a device for monitoring operation efficiency and temperature increase of hardware, and more particularly, to a device having the heat dissipation function and operative to monitor and display hardware operation efficiency and temperature variation. The monitoring device of a heat dissipation device can be driven via control of a panel or operation system.

In the information era, information equipment such as computer hardware is highly demanded in the office. For the routine application, requirement of high efficient operation has consequently advances the functionality and quality of hardware components, such as high-frequency operation of central processing unit, display card, operation of hard disk. However, the problem accompanied with the high efficient operation is the increased heat generated thereby. How to efficiently dissipate the heat has thus become an important topic in the industry. Currently, heat dissipation devices have been attached to the components which generate great amount of heat. For example, a heat dissipation device and a fan are typically mounted on a central processing unit for quickly dissipate heat generated based on heat conviction and conduction, so as to reduce the operation temperature. Other proposals include the "computer peripheral for temperature control and wind speed adjustment" disclosed in Taiwanese Patent No. 553425 and the "external device for fan control and monitoring computer temperature" disclosed in Taiwanese Patent No. 573760. In these proposals, a temperature sensing circuit or a temperature information retrieving unit is used to derive the temperature variation of hardware, so as to achieve heat dissipation by using control circuit or processing unit to control the fan. In addition, a display unit is also available for displaying the operation status. However, in the above proposals are all directed to the temperature sensing and fan driving issues and mechanical or electronic operations. The monitoring process of the hardware temperature does not provide heat dissipation itself.

BRIEF SUMMARY OF THE INVENTION

It is therefore a substantial need for implanting the heat dissipation function into the monitoring device, such that at the time the hardware is monitored, the heat dissipation can be performed in a real time.

A monitoring device that has the heat dissipation function is thus provided. The monitoring device is preferably operated and controlled via a control panel or an operation system of a computer host.

The monitoring device as provided can be used in a computer system to monitor the performance of hardware installed in the computer system, for example, the operation temperature, transmission speed of a hard disk or the temperature of a central processing unit (CPU). Through the connection established by a firmware, the monitoring device can be operated to perform adjustment and access monitor information from an operating system of the computer.

Therefore, the user can select between the control panel or the operation system of the computer host to monitor the temperature variation of the hardware monitored by the monitoring device. The user can also perform adjustment of the heat dissipation in response to the temperature variation in the operating system directly. Further, as the monitoring device has the heat dissipation function, the hardware is protected while it is monitored. The monitoring device can monitor more than one hardware at a time. The operating system also allows the temperature variations for various hardwares displayed at the same time.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
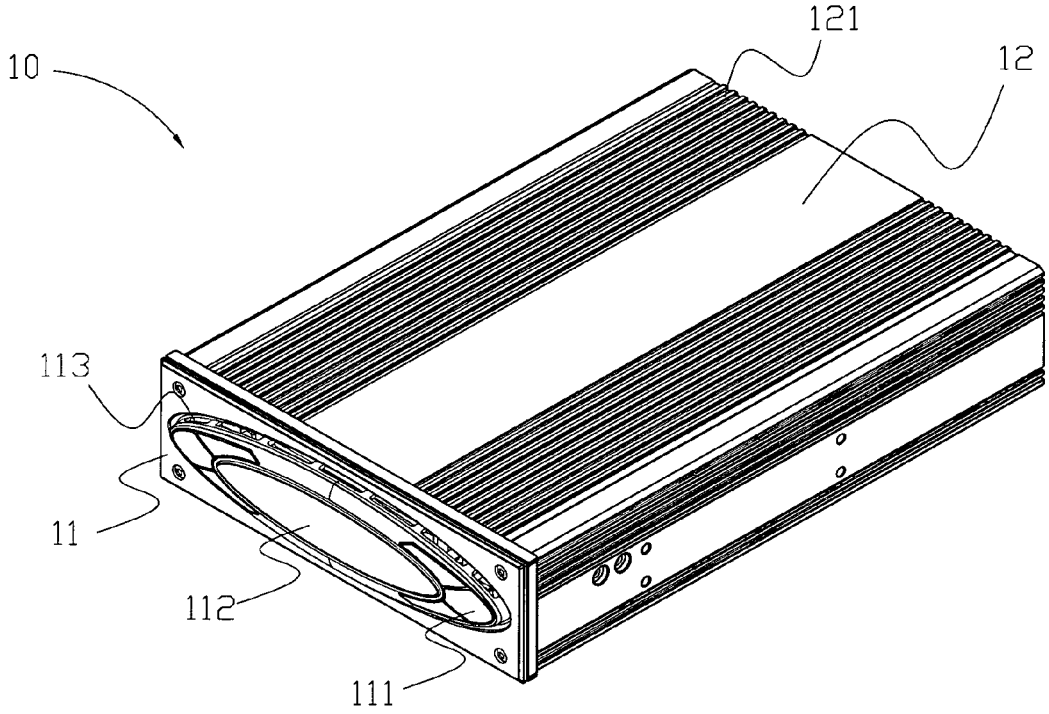
FIG. 1 is a perspective view of a monitoring device provided by the present invention.

Referring to FIG. 1, a perspective view of a hardware monitoring device 10 is illustrated. The monitoring device includes a control panel 111, a box 12, a plurality of control keys or buttons 111 and a display 112. The box 12 has a receiving space (not shown) and a plurality of fins 12 formed on a surface thereof, such that the monitoring device 12 itself provides heat dissipation function.

Figure 2:
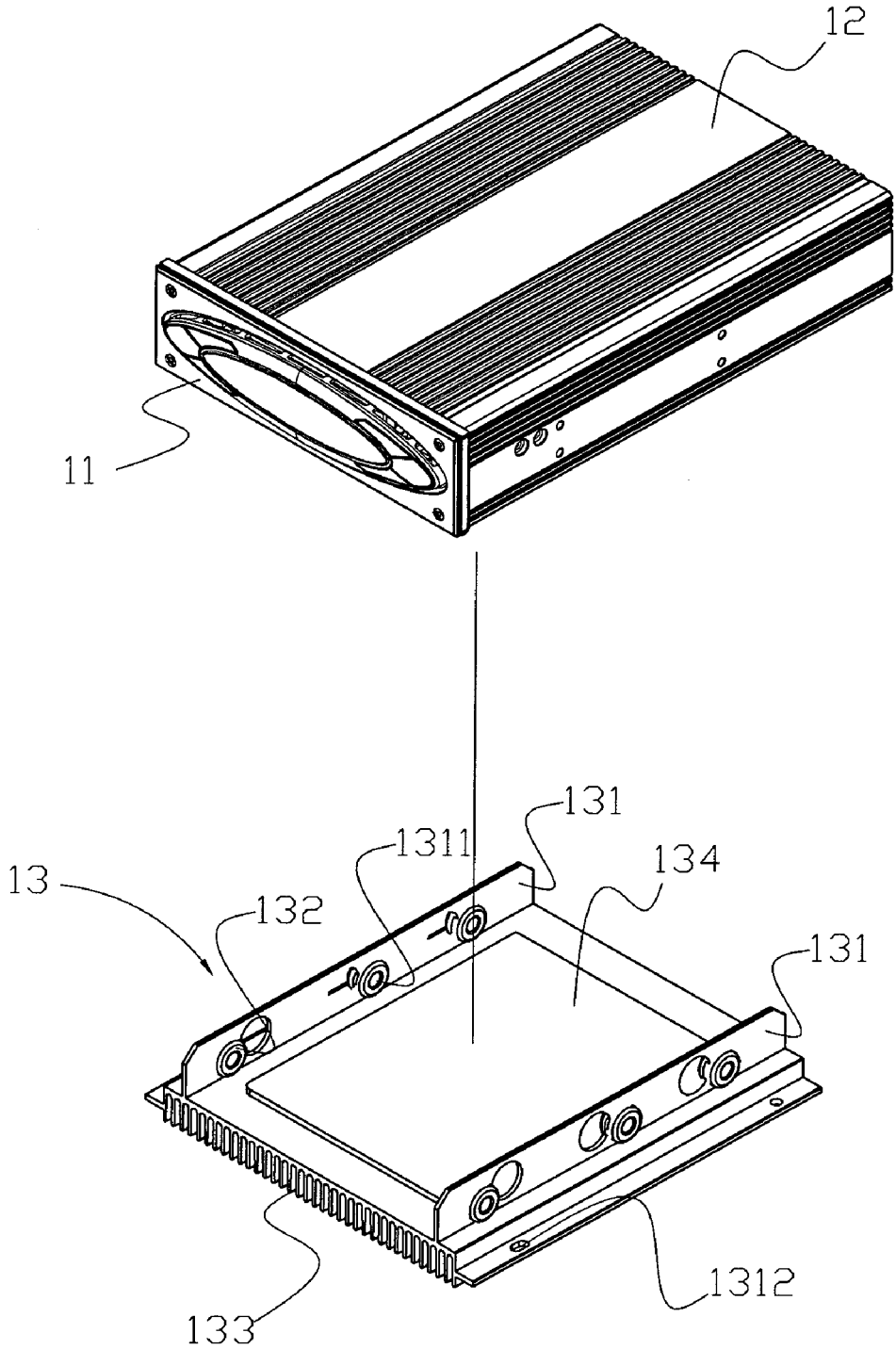
FIG. 2 shows the assembly of the device.

Referring to FIG. 2, a carrier 13 is provided for carrying the box 12 therein. The carrier has two protruding sides serving as a pair of blocking walls 131. Through holes 1311 are formed in the blocking walls 131, such that the box 12 can be secured on the carrier 13 by screw members. A vibration absorption pad or washer 135 may be applied on each of the holes 1311. The bottom surface of the carrier 13 also includes a plurality of fins 133. A heat paste 134 is applied on the top surface of the carrier 13, such that a close contact between the box 12 and the carrier 13 can be obtained. Holes 1312 are also formed through the horizontal edges protruding laterally from the blocking walls 131 to provide additional fastening mechanism.

Figure 3:
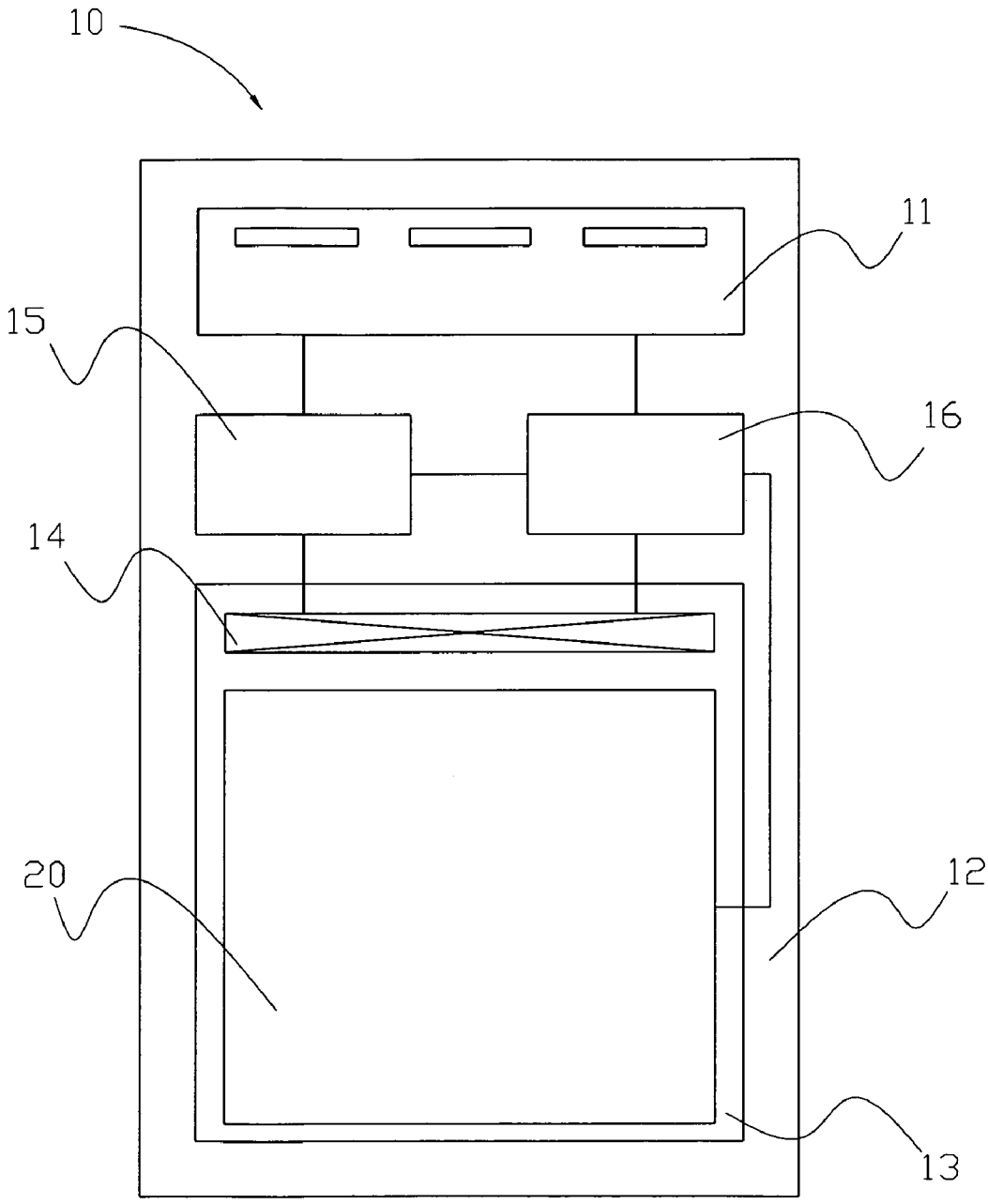
FIG. 3 shows a block diagram of the device.

Referring to FIG. 3, the monitoring device includes a control panel 11, a space formed by the box 12 and the carrier 13, a heat dissipation fan 14, a control module 15 and a monitoring module 16.

The control module 15 includes a digital electronic module, which has multiple functional options such as switch and adjustment between UP/DOWN, ON/OFF or ° C./° F. The control module 15 is connected to the control panel 11. By the operation of the control panel 11, the control module 15 is driven to make the required option such as switching between UP/DOW or ° C./° F. The control module 15 is also connected to the heat dissipation fan 14. By the voltage adjustment, the rotation speed of the heat dissipation fan 14 is controlled.

The monitoring module 16 is connected between a hardware 20 (such as a hard disk) to be monitored thereby and the control module 15. If the hardware 20 is connected to a host system, the monitoring module 16 may also be connected between the host system and the control module 15, such that monitoring module 16 can monitor the hardware 20 via the connection of the host system. The monitoring module 16 includes at least a temperature monitoring unit. An additional hard disk monitoring unit can also be included. The temperature monitoring unit can be connected or attached to the monitored hard ware to monitor temperature variation thereof. Alternatively, the temperature monitoring unit can be connected to the motherboard of the host system to monitor the hard ware through the motherboard. The monitoring module 16 is also connected to the control panel 11, such that the monitored information can be displayed by a screen 112 controlled by the control panel 11. The monitoring module 16 is also connected to the heat dissipation fan 14 to monitor performance such as rotation speed thereof. A warning unit may also be installed in the monitoring module 16 to alert the user when the temperature reaches an upper limit. The warning unit includes a buzzer or a signal light, for example.

Figure 4:
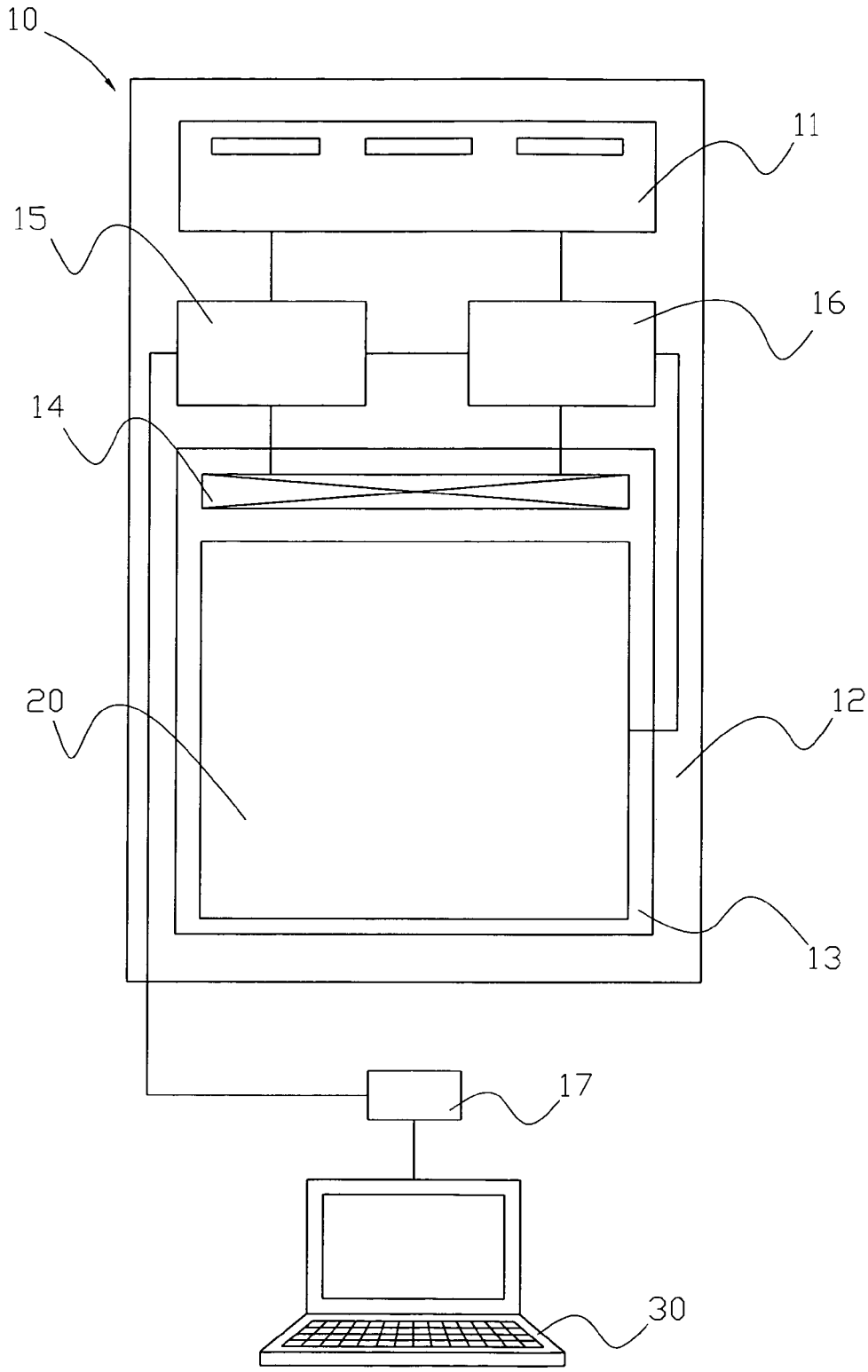
FIG. 4 shows the application of the device.
Figure 5:
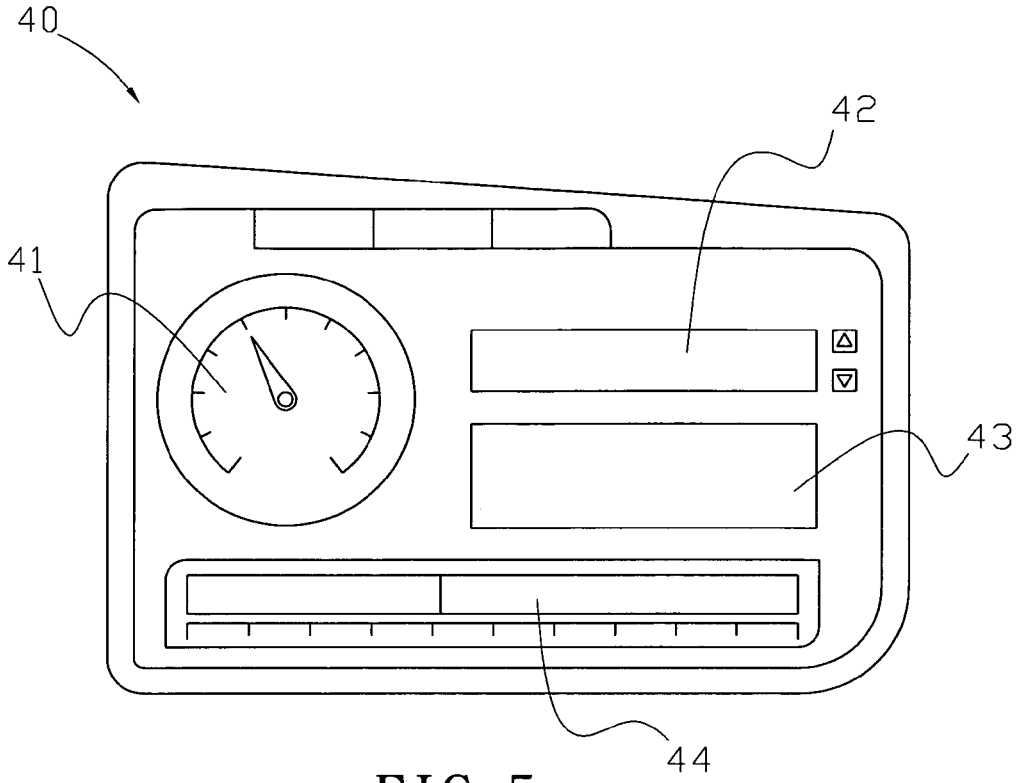
FIG. 5 shows the operation status displayed by the operating system.

Referring to FIG. 4, the monitoring device 10 is applied to a computer. A firmware (a monitoring program) 17 is written in the control module 15. The connection between the hardware monitoring device 10 and the computer operating system 30 is established. The monitored information can then be simulated into a controller and an indicator allowing the user to observe the hardware performance and temperature while operating the operating system. The user can also use the controller to adjust operation parameters such as the rotation speed of the fan. Referring to FIG. 5, a simulated efficiency indicator 40 can be used to digitize the monitored information efficiency of the hardware such as the hard disk. A display panel can thus be simulated to include the following display windows:

(1) Meter-like display region 41 for operation efficiency;
(2) Selection of monitored hardware 42;
(3) Display region 43 for digitized operation efficiency; and
(4) Elongate display region 44.

A speed-transmission simulated unit of the monitored simulation program 17 converts the information obtained by the monitoring unit into digital information and displays the digital information in the computer operating system, such that the user can read the converted information of the monitored hardware from the screen of the operation system directly.

Figure 6:
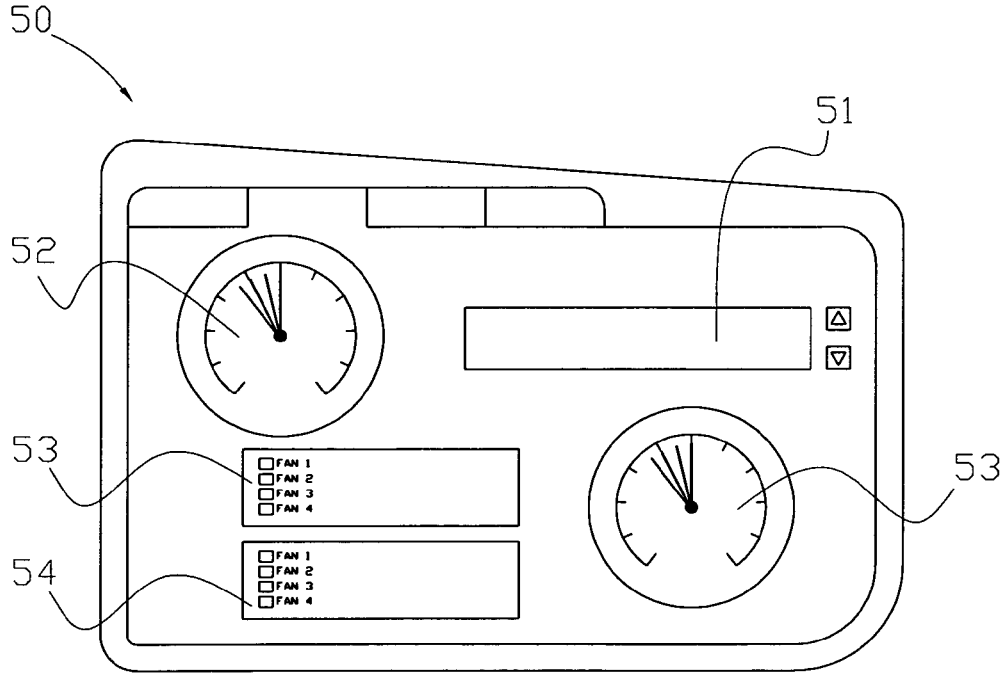
FIG. 6 shows the operation status displayed by the operating system.

FIG. 6 shows a temperature variation simulation indicating meter 50. The operation information of the heat dissipation fan was monitored and digitized and displayed on a display panel, which comprises the following windows:

(1) Heat dissipation fan selection 51;
(2) Rotation-speed meter for the heat dissipation fan 52;
(3) Temperature display meter 53;
(4) Adjustment knob or button 54; and
(5) Display region for digital information.

A temperature simulation unit of the monitor simulation program 17 converts the monitored temperature variation into digital information and displays it in the computer operating system, such that the user can read the operation information of the heat dissipation fan from the operation system directly.

Figure 7:
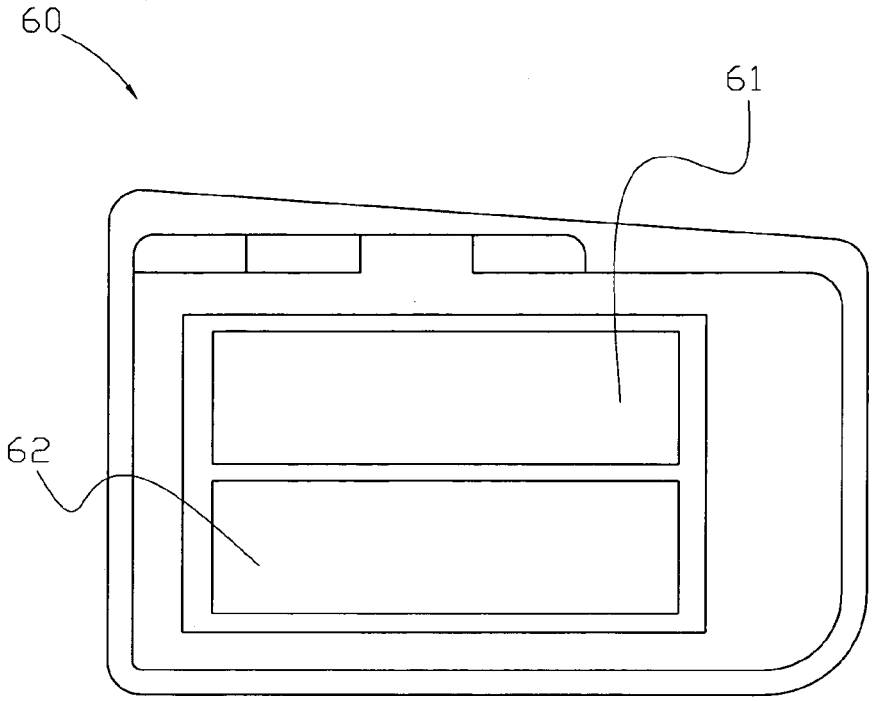
FIG. 7 shows the operation status displayed by the operating system.

FIG. 7 shows a simulation control board 60 for the fan operation status. The simulation control board 60 is used to set up condition, so as to monitor the idling status of the heat dissipation fan. The display includes the follow display windows:

(1) Information region 61 to display the information of the hardware to be monitored; and
(2) Setup region 62, having at least the setup option for timing.

A controller simulation unit of the monitor simulation program 17 is used to simulate a plurality of functions of the control module into digitized function keys displayed in the operating system.

Figure 8:
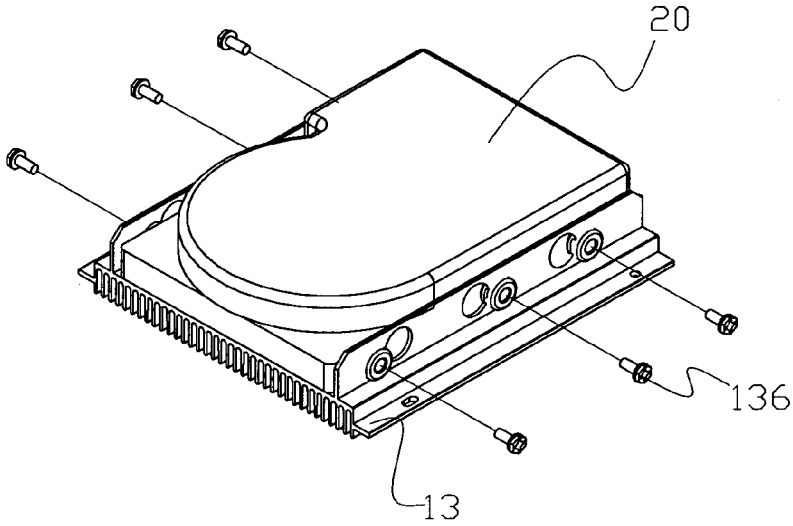
FIG. 8 shows a perspective view of the device.
Figure 9:
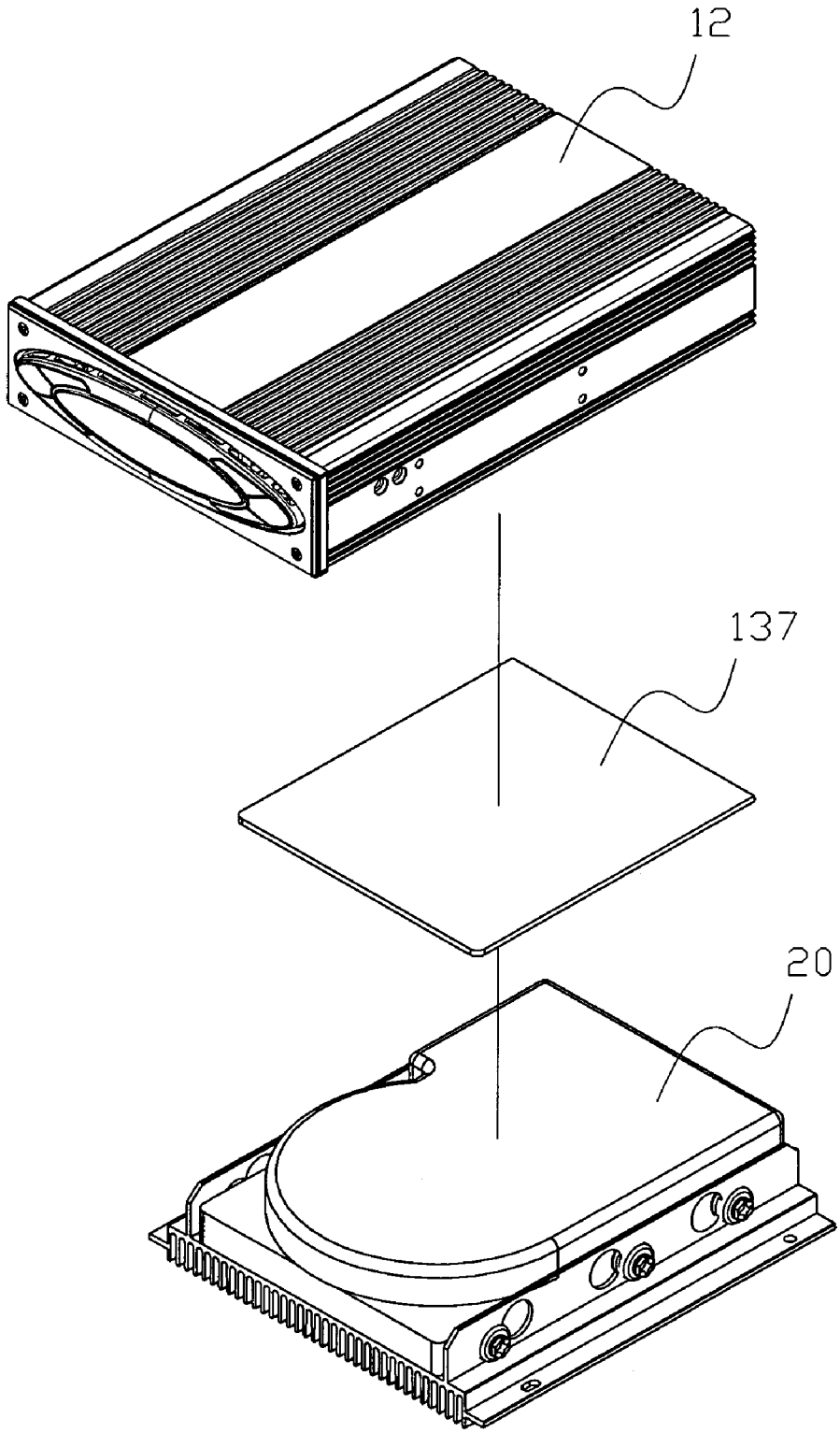
FIG. 9 shows the assembly of the device in another embodiment.

Referring to FIG. 8, another embodiment of a hardware monitor device is illustrated. As shown, the hard disk 20 is disposed on a carrier 13 before being installed in the computer host system. Referring to FIG. 9, fastening members such as screws 136 are used to secure the hard disk 20 to the carrier 13. The assembly of the hard disk 20 and the carrier 13 is installed in a container 12 as shown in FIG. 1. In this embodiment, the container 12 has an open bottom allowing the assembly of the hard disk 20 and the carrier 13 disposed therein from the bottom to the top thereof. A cross sectional view of the assembly can be referred to FIG. 11. A layer of heat dissipation paste 137 may be applied between the container 12 and the assembly to improve heat dissipation efficiency.

Figure 10:
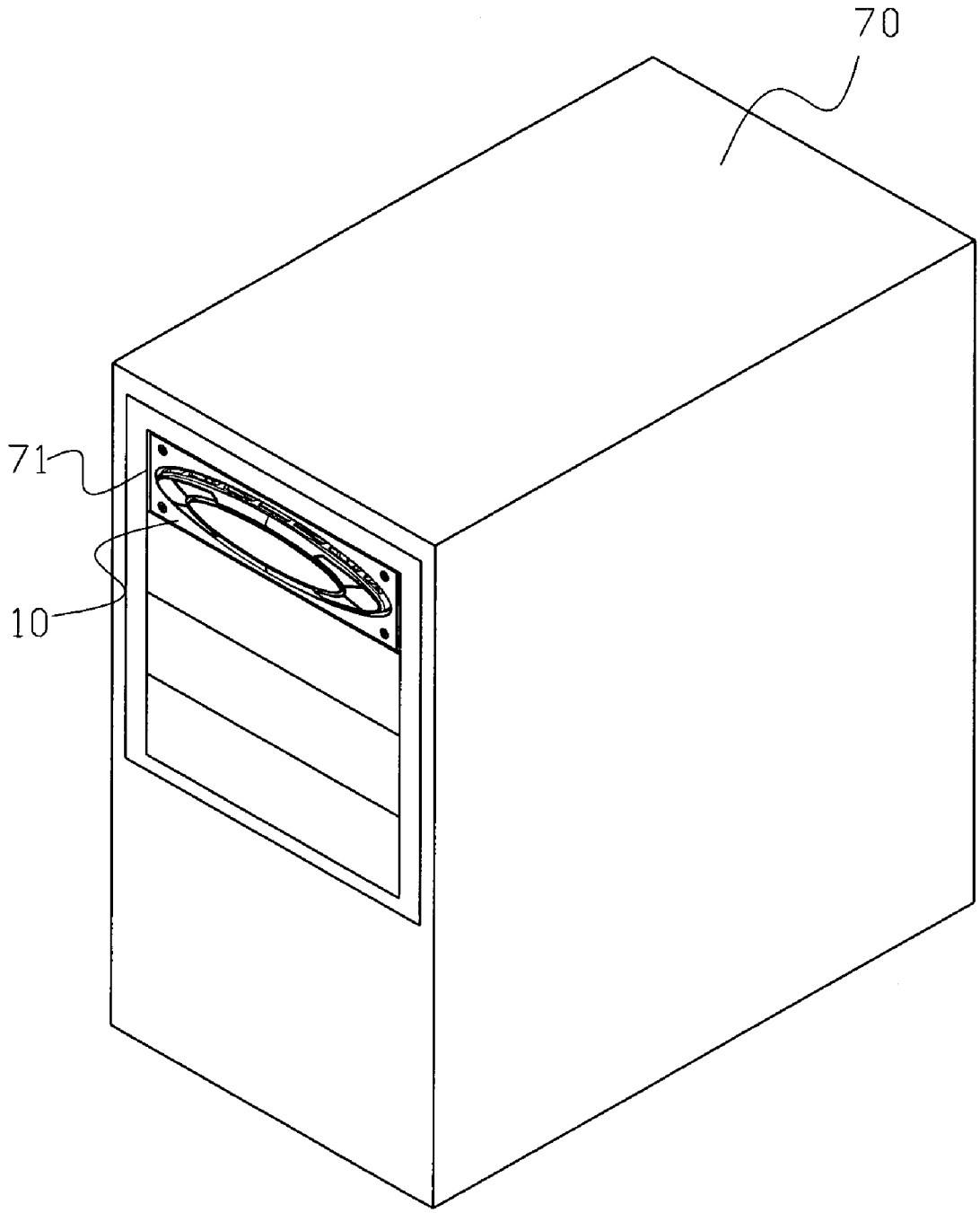
FIG. 10 shows the application of the device.

Referring to FIG. 10, the hard disk assembly a shown in FIG. 9 is then slide into a slot 71 of a computer host 70 to operate when the electric connection is established.

Figure 11:
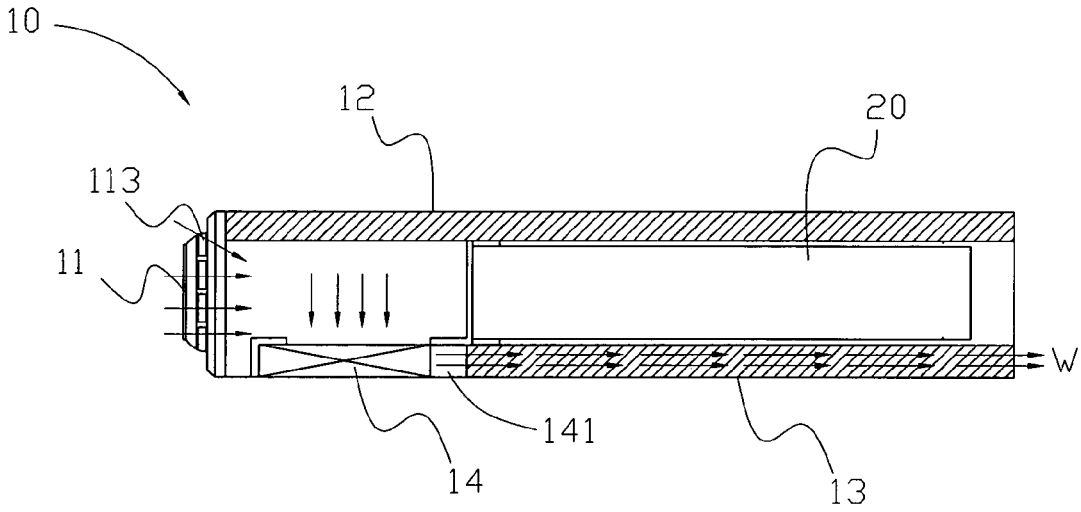
FIG. 11 shows the heat dissipation function of the device.

In the embodiment as shown in FIG. 11, the carrier 131 and the container 12 extends laterally over the hard disk 20 and the carrier 13, such that an open portion is formed in front of the hard disk 20. The open bottom of the container 20 thus leaves an opening at the bottom of the hard disk assembly. As shown, a control panel 11 is attached to a front side of the hard disk assembly. A plurality of venting holes 113 is formed at a periphery of the control panel 11 allowing ambient air to flow into the hard disk assembly. A plurality of fins 121 is formed on an external surface of the container 12, and a plurality of fins 133 is formed on a lower side of the carrier 13 to increase heat dissipation area. A heat dissipation fan 14 is installed at the opening of the hard disk assembly under the open space as described above. Therefore, as shown by the arrows in FIG. 11, air in the space can be circulated towards the channels between the fins 131, while ambient air can be circulated into the space through the venting holes 113 when the fan 14 is operating. The flow direction of the air is denoted by W in FIG. 11. The heat flowing through the channels between the fins 133 can thus be dissipated efficiently thereby.

Figure 12:
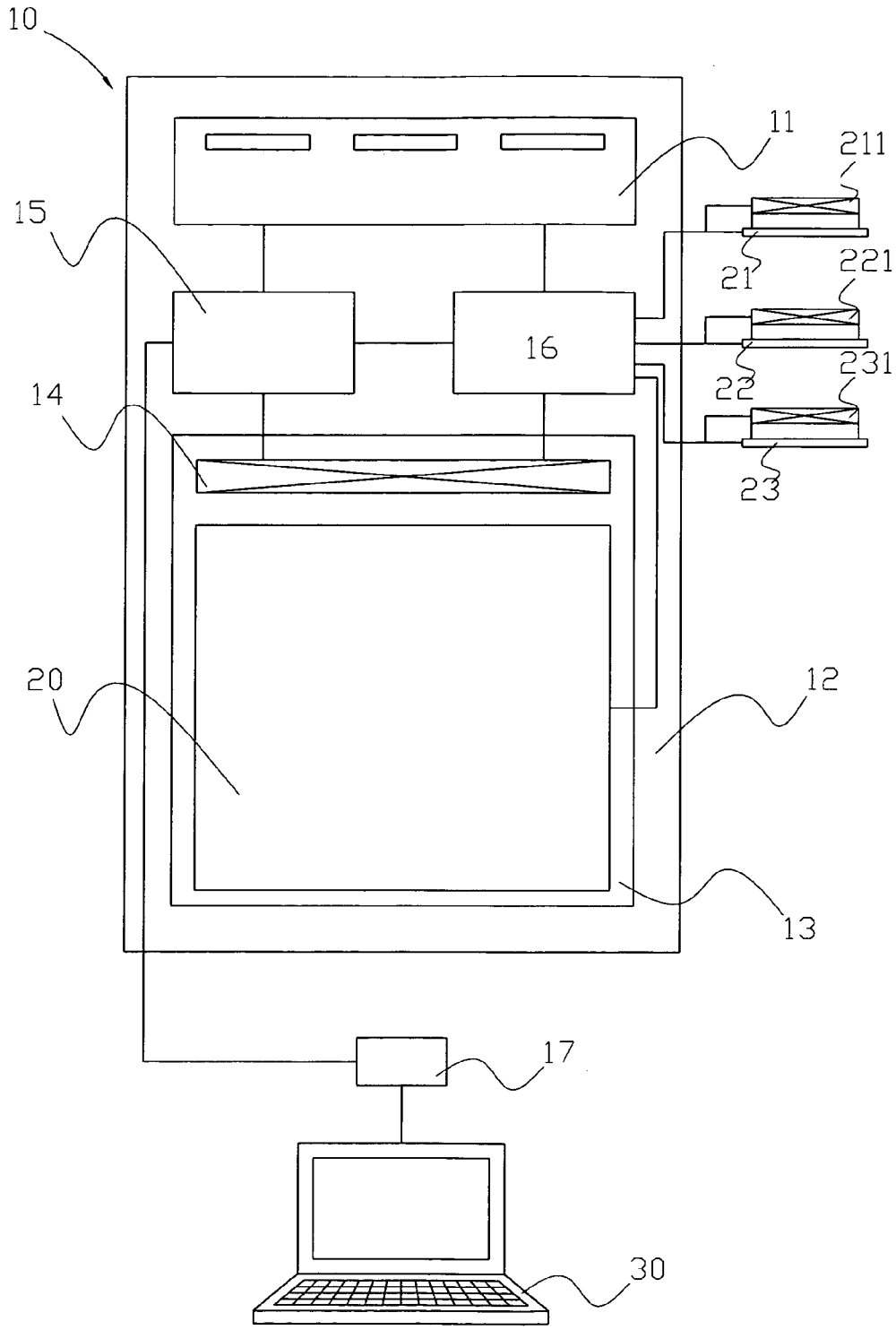
FIG. 12 shows the device applied to a computer host.

Referring to FIG. 12, another embodiment of the hardware monitor device is illustrated. In this embodiment, a plurality set of electric wires is used to establish connections between multiple hardwares 21, 22, 23 and fans 211, 212 and 213 simultaneously.

The hardware monitor device as provided thus has at least the following advantages:

(1) The user can make selection of control from the control panel of the container or the screen of the computer operating system directly;
(2) The user can perform hardware operation and temperature monitor on multiple hardwares simultaneously;
(3) A real time adjustment of the rotation speed of the heat dissipation fan can be performed; and
(4) The monitor device is a heat dissipation device itself, such that the operation thereof provides heat dissipation effect.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A hardware monitor device, used to monitor and control performance and temperature of a hardware and provide heat dissipation at the same time, comprising:

a control module, having a plurality of function selections;

a monitor module connected the hardware to the control module, the monitor module being operative to at least monitor temperature of the hardware a control panel, electrically connected to the monitor module to operate the function selections of the control module, the control panel having at least a display region for displaying information monitored by the monitor module and an adjustment condition of the control module; and a container and a carrier for installing the hardware therein, so as to form a hardware assembly in which a space is formed in front of the hardware, and a heat dissipation fan is installed under the space, wherein the monitor module includes a unit for monitoring transmission speed of a hard disk.

2. The device of claim 1, wherein the monitor module includes a temperature variation monitor unit.

3. The device of claim 1, wherein the monitor module includes a warning unit for an upper limit of temperature.

4. The device of claim 3, wherein the warning unit includes a buzzer to generate audio warning signal.

5. The device of claim 1, wherein the monitor module includes a plurality of electric wires connected to a plurality of hardwares to perform monitor the hardwares simultaneously.

6. The device of claim 1, wherein control panel provides an access for adjusting voltage applied to the heat dissipation fan, so as to control rotation speed thereof.

7. The device of claim 1, wherein the container has an external surface and a plurality of fins formed on the external surface.

8. The device of claim 1, further comprising a firmware for connecting the monitor unit to a computer operating system, the firmware comprising:

a temperature simulation unit to digitize monitored temperature information of the monitor unit and display the digitized monitored information in the operating system;

a transmission-speed unit to digitize monitored transmission-speed information of the monitor unit and display the digitized monitored transmission-speed information in the operating system; and a controller simulation unit to convert the function selections of the control module into a plurality of digital function keys, and display the digital function keys in the operating system.

9. A hardware monitor device, used to monitor and control performance and temperature of a hardware and provide heat dissipation at the same time, comprising:

a control module, having a plurality of function selections;

a monitor module connected the hardware to the control module, the monitor module being operative to at least monitor temperature of the hardware a control panel, electrically connected to the monitor module to operate the function selections of the control module, the control panel having at least a display region for displaying information monitored by the monitor module and an adjustment condition of the control module;

a container and a carrier for installing the hardware therein, so as to form a hardware assembly in which a space is formed in front of the hardware, and a heat dissipation fan is installed under the space; and a firmware for connecting the monitor unit to a computer operating system, the firmware comprising:

a temperature simulation unit to digitize monitored temperature information of the monitor unit and display the digitized monitored information in the operating system;

a transmission-speed unit to digitize monitored transmission-speed information of the monitor unit and display the digitized monitored transmission-speed information in the operating system; and a controller simulation unit to convert the function selections of the control module into a plurality of digital function keys, and display the digital function keys in the operating system.

10. The device of claim 9, wherein the monitor module includes a temperature variation monitor unit.

11. The device of claim 9, wherein the monitor module includes a unit for monitoring transmission speed of a hard disk.

12. The device of claim 11, wherein the monitor module includes a warning unit for an upper limit of temperature.

13. The device of claim 12, wherein the warning unit includes a buzzer to generate audio warning signal.

14. The device of claim 9, wherein the monitor module includes a plurality of electric wires connected to a plurality of hardwares to perform monitor the hardwares simultaneously.

15. The device of claim 9, wherein control panel provides an access for adjusting voltage applied to the heat dissipation fan, so as to control rotation speed thereof.

16. The device of claim 9, wherein the container has an external surface and a plurality of fins formed on the external surface.

* * * * *